US005182889A

United States Patent [19]

Johnson

[11] Patent Number: 5,182,889

[45] Date of Patent: Feb. 2, 1993

[54] BARRIER SYSTEM

[76] Inventor: Dennis Johnson, 21202 139th Ave. SE., Snohomish, Wash. 98290

[21] Appl. No.: 641,753

[22] Filed: Jan. 14, 1991

[51] Int. Cl.[5] ..... E02D 27/42

[52] U.S. Cl. ..... 52/298; 182/113

[58] Field of Search ..... 52/238, 297, 298; 182/113, 82; 256/59.65, DIG. 6

[56] References Cited

U.S. PATENT DOCUMENTS

| | | |
|---|---|---|
| 541,323 | 6/1895 | Gewiss . |
| 2,329,415 | 9/1943 | Osborne . |
| 2,706,662 | 4/1955 | Brown . |
| 2,916,245 | 12/1959 | Williams . |
| 3,425,509 | 2/1969 | Gilbert et al. . |
| 3,472,338 | 10/1969 | Weidman et al. . |
| 3,880,405 | 4/1975 | Brueske . |
| 3,949,834 | 4/1976 | Nusbaum . |
| 4,132,287 | 1/1979 | Parolini . |
| 4,236,698 | 12/1980 | Compte . |
| 4,787,475 | 11/1988 | Arteau et al. . |
| 4,838,382 | 6/1989 | Nusbaum . |

*Primary Examiner*—Richard E. Chilcot, Jr.
*Assistant Examiner*—Creighton Smith
*Attorney, Agent, or Firm*—Robert M. Bellomy

[57] ABSTRACT

A barrier system that is lightweight and exceeds existing safety regulations is disclosed. The barrier system has a plurality of rod-like, elongated bodies, a bracket system to affix the elongated bodies to a structure where the barrier is desired, and an attachment for fixedly, but removably, attaching webbing to the elongated bodies to create the barrier. In a number of preferred embodiments, the attachment mechanism is formed from a plurality of loops arrayed along each elongated body with the loops forming a plurality of substantially aligned openings arrayed along the elongated body. A locking pin is placed through the aligned openings on an elongated body after the webbing has been placed against the elongated body. A variety of bracket systems are disclosed which allow the barrier system to be used in virtually unlimited applications for temporary barriers.

10 Claims, 7 Drawing Sheets

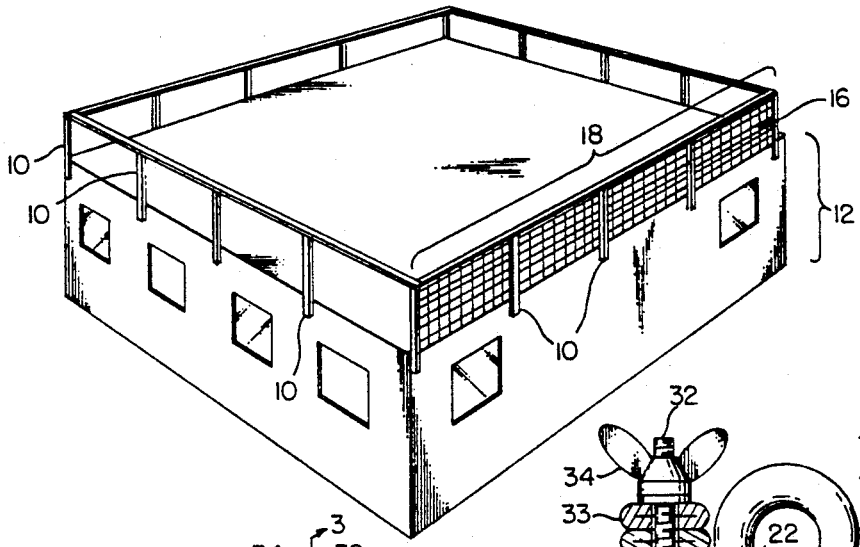
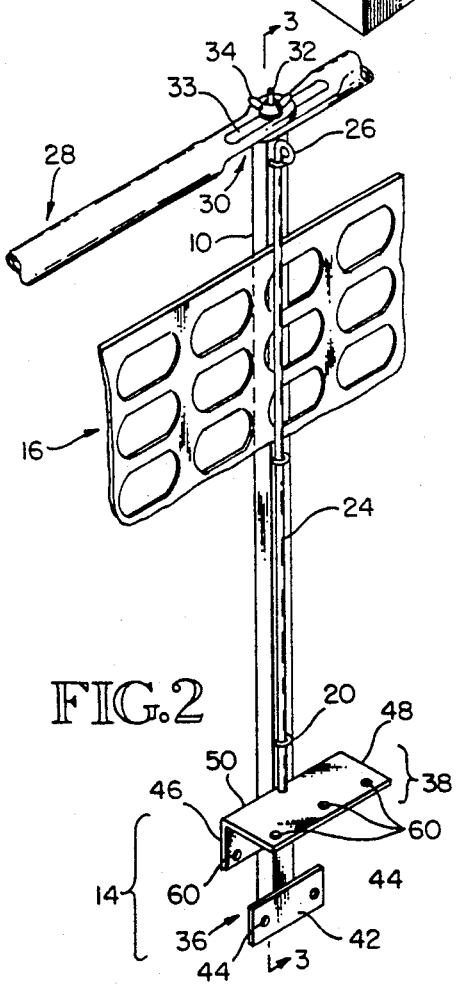
FIG. 2
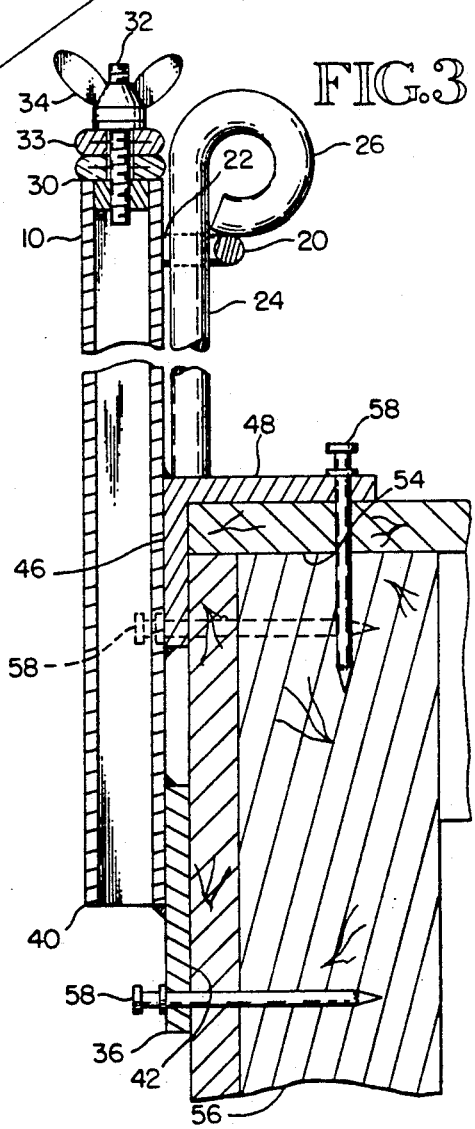
FIG. 3

FIG. 7
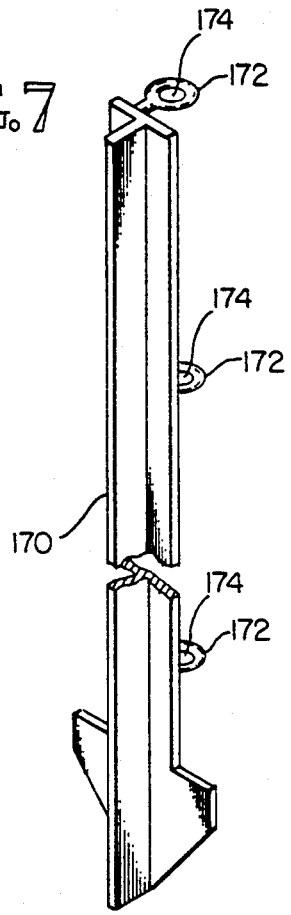
FIG. 7B
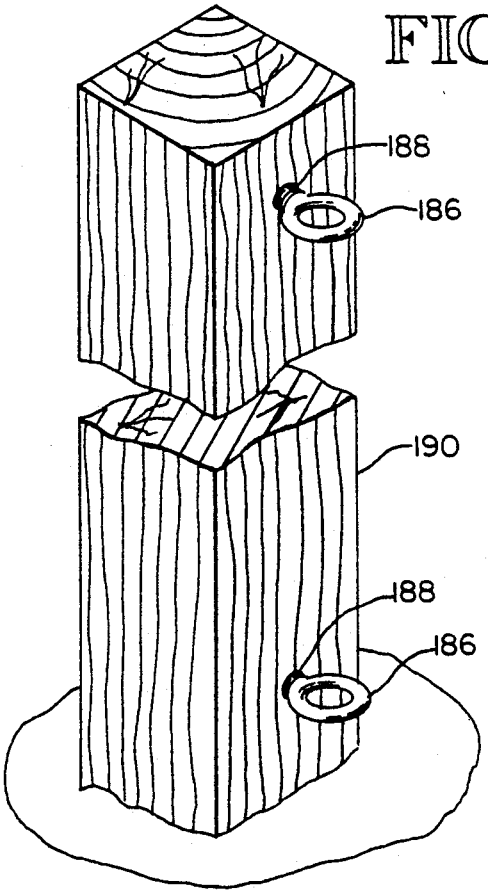
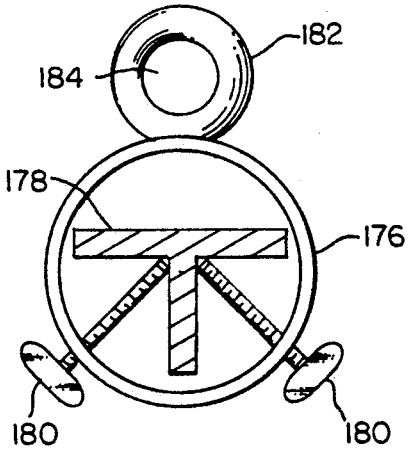
FIG. 7A

BARRIER SYSTEM

TECHNICAL FIELD

The present invention relates to a barrier system. More particularly, the present invention relates to a barrier system with a plurality of rod-like elongated bodies, a bracket system to affix the bodies to the desired structure, and an attachment mechanism for fixedly, but removably, attaching a variety of different webbing materials to the elongated bodies.

BACKGROUND OF THE INVENTION

In a number of situations such as construction sites, there is a need for barrier devices, such as fencing or railings that are temporary but at the same time are sufficiently strong to prevent accidents by withstanding the forces generated in circumstances such as a man losing his footing and falling against the railing. In job related situations, the government has recognized the need for such safety restraints through the enactment of regulations by such government agencies as Occupational Safety and Health Administration ("OSHA"), for example.

As construction contractors and other entities attempt to comply with governmental regulations such as the OSHA regulation, they are presented with several difficulties. For example, railings or fencing constructed by nailing pieces of wood such as 2×4's together will not comply with existing regulations since such constructions are insufficiently strong to be effective as safety restraints. Also, the use of lumber generates a large amount of scrap that is generally unusable for other purposes on the construction site. Still, many contractors continue to construct such inadequate safety restraints since there have not been practical barrier systems available, and thereby expose themselves to increased costs from higher insurance rates and fines by OSHA, their workers to accidents, and generate literally millions of dollars of unusable scrap lumber.

Other attempts to provide safety restraint devices that are effective and comply with government regulations have resulted in heavy, complicated railing systems which can be expensive both in initial purchase price, and in time and labor required to transport and assemble them. Such systems may require complicated mechanisms for attaching them to the various structures on a construction site which also limits the structures to which they can be attached. They also require very specialized pieces which are not interchangeable with other construction systems.

Another type of safety system is an apparatus which uses harnesses worn by individual workers that are attached to one end of a safety line and the other end of the safety line is attached to an anchoring device or anchoring means. This type of barrier system represents a number of problems in providing safety. Such devices limit the movement of workers while performing their job duties which also results in workers being reluctant to use the devices, further reducing their effectiveness.

These devices also can actually cause an accident and serious injury to workers involved in an accident. For example, if a worker falls from a roof backwards or sideways while wearing a safety belt, a sudden stop caused by a safety belt reaching the end of its tether can actually cause spinal or internal injuries to the worker. Also, workers, feet can become entangled in the safety lines, causing accidents. In addition, such systems are also expensive to make, to purchase, and to install.

Some of the same problems discussed above occur in areas other than construction where temporary railing or fencing is required to contain or restrain something or someone. An example of this would be a temporary fencing of livestock.

As illustrated by the above discussion, there are a number of desirable features for a barrier system. It would be desirable to have a lightweight barrier system that would provide protection for workers and exceed existing safety regulations. It also would be desirable to have a barrier system that is inexpensive and easy to manufacture, purchase, and use. Additionally, it would be desirable to have a barrier system that could be easily adapted for use with the varying conditions found on a construction site. It further would be desirable to have a barrier system with components that are readily replaceable and interchangeable. It also would be desirable to have a barrier system that can be adapted for use with existing restraint systems and structures.

While the discussion herein relates to the barrier system, it is not intended that the invention be limited to this situation. It will be obvious from the description that follows that the present invention will be useful in other applications with problems common to those described herein.

DISCLOSURE OF THE INVENTION

It is the object of the present invention to provide a barrier system that is lightweight and effective.

It is another objective of the present invention to provide a barrier system that is inexpensive and simple to manufacture, purchase, and use and install.

It is a further object of the present invention to provide a barrier system that is readily adaptable to the variety of conditions and environments found at a construction site.

It is yet another object of the present invention to provide a barrier system with component parts which are interchangeable.

It also is the object of the present invention to provide a barrier system that can adapted for use with existing restraint systems and structures.

The present invention achieves these and other objectives which will become apparent from the description that follows by providing a barrier system which has a plurality of rod-like elongated bodies, a bracketing system to affix the bodies to the construction structures, and an attachment mechanism for fixedly, but removably, attaching webbing material to the elongated bodies.

In a preferred embodiment of the present invention, the attachment mechanism has a plurality of loops attached to and arrayed along each elongated body. On each body, the loops form a plurality of openings that are substantially aligned with each other along the elongated body. When the elongated bodies have been positioned and affixed to the desired construction area, webbing is arrayed along the elongated bodies. The loops on the elongated bodies extend through the webbing and at each body, a locking pin is passed through the aligned loop openings, thereby fixing the webbing in place. When the webbing has been put in position and locking pins placed in each body, a safety restraint barrier is formed. Top rails which attach the elongated bodies tops together can be used to insure greater safety by strengthening the fence.

In this and other preferred embodiments, the elongated bodies oriented with the aligned loops extending into the space where the workers will be located. As a result, the webbing is arrayed between the space to be enclosed and the elongated body so that the elongated bodies, not the loops and locking pins, provide the structural strength to the restraint system.

The attachment mechanism for the alternative preferred embodiments is substantially similar to the one described above. One of the significant differences among the alternative preferred embodiments is the bracket system for affixing the elongated bodies to the construction structures. Regardless of the embodiment, the bracket system affixes the elongated body to a construction structure in a substantially upright orientation to provide the necessary structure for the webbing.

In one preferred alternative embodiment, the bracket system has an upper bracket that is a flat plate attached to the elongated body so that the flat plate planar surface is substantially parallel to the elongated body. The upper bracket extends from the elongated body in the same direction as the loops. This embodiment also has a lower bracket that is extending downward from the lower end of the elongated body and with a planar surface oriented in the same direction as the loops and perpendicular to the upper bracket planar surface. Each of the brackets has holes through it so that nails can driven from different directions to attach the body to wooden structures.

When an elongated body using this bracket system is placed next to the side of a piece of lumber, nails driven through the holes in the brackets are perpendicular to each other due to the orientation of the brackets. Thus, the bodies are fixed in both horizontal directions to maximize shear strength.

In another alternative preferred embodiment, two brackets also are used. A horizontal lower bracket, which extends outward to the sides of the elongated body instead of downward from the end, is attached to the lower end of the elongated body. The horizontal lower bracket has a planar surface oriented in the same direction as the loops on the elongated body.

The second bracket is an upper bracket formed from two plates connected along a common edge at approximately 90° so that when viewed from an end the upper bracket is "L-shaped". When the upper bracket is attached to the elongated body, a first plate is fixed to the body itself with a planar surface oriented in the same direction as the loops on the elongated body and parallel to the horizontal lower bracket planar surface. The second plate extends outward from the elongated body and is oriented so that the elongated body is substantially normal to the second plate planar surface. There are holes through both plates for nails which position nails through the first plate and nails through the second plate perpendicular to one another. An alternative preferred embodiment of the present invention, which also uses the above described "L-shaped" upper bracket, incorporated a spacer which allows the barrier system to be used in situations where concrete is being poured.

Another alternative preferred embodiment is substantially similar to the embodiment described immediately above and uses an upper bracket with two plates in the "L-shaped" configuration with the upper bracket attached to the elongated body in substantially the same orientation. In this embodiment, however, the upper bracket is attached so that it pivots in one dimension relative to the elongated body. Thus, while the planar surface of the first plate remains substantially parallel to a lower bracket planar surface, the planar surface of the second plate can be changed relative the elongated body. This embodiment is useful particularly in providing a safety restraint barrier on unfinished stairways. An lower bracket as described in the above embodiments also is used.

Another preferred embodiment of the present invention uses an elongated body and an attachment mechanism similar to those described in the above embodiments. Extending from the lower end of the elongated body is a curved bracket with a "J-shape". The cup portion of the curved bracket is placed around the bottom of a piece of lumber and nailed in place so that the elongated body extends upward. A brace is attached at its first end to the elongated body along its length. The brace second end has a pivoting bracket attached to it. The brace bracket is nailed to a flat portion of a roof or unfinished floor to secure the top of the elongated body. In this embodiment, the elongated body and brace can be two separate pieces that are attached together at the construction site or can be pivotally attached together during construction. Secondary brace also can be used with this embodiment to further strengthen the elongated bodies.

Among other preferred embodiments is an embodiment that uses an attachment mechanism similar to those described above with conventional fence posts to allow the rapid construction of temporary fencing on the ground for livestock, for example. Another embodiment uses a modification of the attachment mechanism described above to create a temporary load cover for trucks and similar vehicles. Additional embodiments involve modified bracket systems to enable the present invention to be used in steel based construction such as high rise buildings and bridges. Another preferred embodiment uses a plurality of loops which can be attached to existing structures or restraint systems and allows a barrier to constructed with the existing structures or restraint systems.

BRIEF DESCRIPTION OF THE DRAWINGS

FIG. 1 is a perspective view of a preferred embodiment constructed in accordance with the present invention.

FIG. 2 is a partial side isometric view of a preferred embodiment constructed in accordance with the present invention.

FIG. 3 is a partial cross-sectional view of a preferred embodiment constructed in accordance with the present invention taken along lines 3—3 in FIG. 2.

FIG. 7 is a partial isometric view of an alternative preferred embodiment constructed in accordance with the present invention.

FIG. 7A is a partial isometric view of an alternative preferred embodiment constructed in accordance with the present invention.

FIG. 7B is a partial isometric view of an alternative preferred embodiment constructed in accordance with the present invention.

BEST MODE IN CARRYING OUT THE INVENTION

Figure 4:
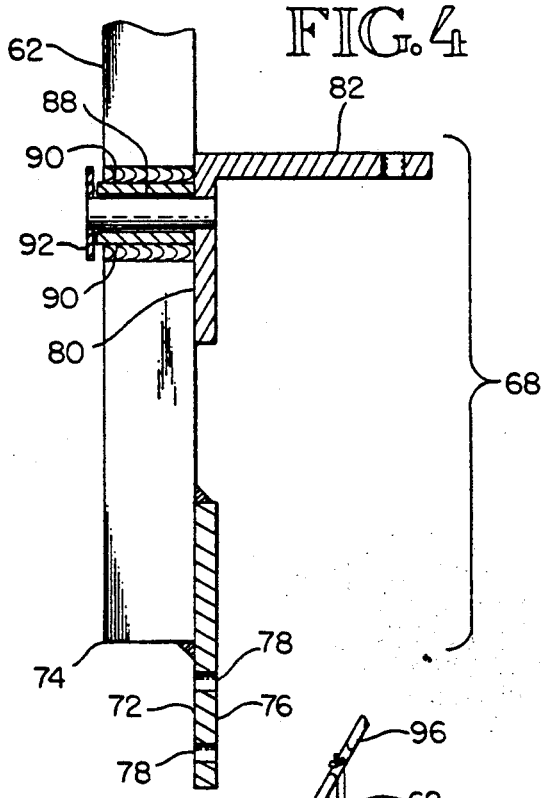
FIG. 4 is a partial cross-sectional view of an alternative preferred embodiment constructed in accordance with the present invention taken along lines 4—4 in FIG. 4A.

With reference to FIGS. 1 through 3, a barrier system is shown. There are a plurality of rod-like elongated bodies 10 which are positioned about and attached to a construction structure 12 where a barrier system is desired. Each elongated body is attached to the structure with a bracket system 14, which is discussed in greater detail below. After the individual elongated bodies have been positioned about the area where the restraint is desired, webbing 16 is distributed along the elongated rods to create the barrier 18 shown in FIG. 1.

Attached to each elongated rod is a plurality of loops 20 which form a plurality of openings 22. The openings on each elongated body are substantially aligned with one another along the elongated body. Typically, the loops have openings of substantially the same size. As can be seen in FIGS. 2 and 3, and will be discussed in greater detail herein, the elongated body is oriented so that the loops and corresponding loop openings extend toward the space about which the safety barrier is to be erected. After the webbing has been placed across a specific elongated body, the loops and corresponding openings extend through the webbing which is not solid. A locking pin 24 is then placed through the openings on the elongated body to hold the webbing in place. The locking pin should have sufficient length to be able to pass through all the openings on a particular elongated body simultaneously and should be narrow enough to pass through the smallest opening on any particular elongated body.

Ease of inserting and removing the locking pin is enhanced by providing the locking pin with a closed looped top 26, although the closed looped top is not essential to the operation of the invention. A closed as opposed to open looped top may be required, however, by safety regulations. The loops with their corresponding openings and the locking pins together constitute one possible embodiment of an attachment mechanism for attaching webbing to an elongated body.

Webbing of various configurations can be obtained commercially in rolls and simply rolled out along the elongated bodies to form the barrier. As the webbing is moved from elongated body to elongated body, the attachment mechanism is used to affix the webbing to the elongated body created the completed barrier, which can be enclosed as shown in FIG. 1 or extended only across a specific open area where a barrier may be needed. Top rails 28 that connect the tops 30 of the elongated bodies together can be added to enhance the strength of the overall structure of the barrier. The top rails can be connected to the elongated body tops in a variety of ways. As shown in detail in FIGS. 2 and 3, an elongated body top can have a threaded stud 32 extending from it. In this embodiment, the top rail has flattened, slotted ends 33 which can be placed over the threaded studs. After the top rail has been put into position, the threaded stud can be put through the top rail slotted ends and a wing nut 34 can be tightened down to hold the top rail in place.

While the ends of the top rails shown are closed slots, other configurations such as open-ended slots or simple holes could be used also. A regular nut also can be used, but the wing nut allows the top rails to be installed without the use of tools. While the top rail shown is made with round tubing, square or rectangular tubing is equally suitable. Instead of a threaded stud and nut, a plain stud can extend from the elongated body top with an hole in it. After the top rail has been placed in position and the stud extended through it, a quick-release pin can be placed through the hole in the plain stud, thereby retaining the top rail in place.

A variety of bracket systems can be used with the various preferred embodiments of the present invention. In this embodiment the bracket system has two brackets, a horizontal lower bracket 36 and an upper bracket 38. The horizontal lower bracket is a substantially flat plate attached to the bottom 40 of the elongated body. The horizontal lower bracket has an undersurface 42 which is oriented so that it faces in substantially the same direction that the plurality of loops extend from the elongated body. While not essential for the bracket system to function, this particular example is substantially rectangular and extends laterally beyond the dimensions of the elongated body. There is a plurality of holes 44 through the horizontal lower brackets which are sufficiently large to allow nails to pass through them.

The upper bracket has a first plate 46 and a second plate 48 which are joined together along a common edge 50 at an angle of approximately 90° to form a bracket that is "L-shaped" when viewed from the side. The first plate is attached to the elongated body substantially beneath the plurality of aligned loops with its planar surface oriented parallel to the horizontal lower bracket so that it faces the same direction that the elongated body loops extend. The first plate of the upper bracket and the horizontal lower brackets are substantially parallel. The second plate extends outward from the elongated body in generally the same direction as the elongated body loops. The elongated body itself is substantially normal to the second plate planar surface 54. When in position on the horizontal corner of lumber 56, as shown in FIG. 3, nails 58 are driven through holes 60 in the upper bracket and holes in the horizontal lower bracket to secure the elongated body to the construction structure in an upright orientation that is substantially normal to the plane defined by the ground.

The resistance of the elongated bodies to being removed by lateral force, or the shear strength, is maximized in this and other embodiments of the present invention by using the groups of nails so that they are substantially perpendicular to one another, and so that at least one group of the nails is substantially perpendicular to lateral force against the elongated body. Also, with a bracket system of this and other embodiments, the resulting barrier has the webbing between the elongated bodies and the space to be enclosed. Thus, any pressure against the webbing pulls the webbing against the oriented bodies and not away from the elongated bodies. Thus, the attachment mechanism as represented by the loop and locking pin configuration in this and other embodiments does not have to resist forces against the barrier. It is primarily used simply to locate and fix the net into position against the oriented body.

The resulting barrier exceeds both the practical and legal requirements of an effective safety system. By using double-headed nails as shown in FIG. 3, the elongated bodies can be installed and removed quickly. Finally, as discussed above, the attachment mechanism in this embodiment is as simple as inserting a rod through several aligned openings of the elongated body loops.

When the barrier is no longer needed, it can be disassembled by removing the locking pins one at a time as the webbing is re-rolled. After the locking pins and webbing have been removed, the double-headed nails can be pulled and virtually every part of the barrier system can be reused except the nails. Installing the top rails add some time to the installation and removal but that time is relatively insignificant, especially in view of the added protection provided for those people working in the construction site.

Also important to the ease of installation and removal of the rail system is the relative lightweight nature of the elements of this embodiment of the present invention. The elongated body can be constructed in a variety of shapes and can be constructed with a variety of materials. Great success has been obtained using square, hollow steel tubing approximately one inch in size. Experimentation has also indicated that hollow aluminum tubing with a resin or fiberglass core can be used if extreme strength is needed.

Solid elongated bodies can be used, but the increase in structural strength is not justified by the increased weight and cost in most applications. While square tubing is shown in the figures, the cross-sectional shape of the tubing could just as easily be rectangular, triangular, circular, oval, etc. The choice as to cross-sectional shape of the elongated rod and materials from which they are constructed is dictated by a tradeoff of strength versus cost. With readily available low-cost steel tubing providing structural strength far beyond that required by most applications, exotic materials, while very applicable and useable for this invention, are not necessary to obtain the results required unless greatly increased structural strength or extremely lightweight components might be needed.

The length of the elongated bodies is dictated by practical size limitations and safety regulations. In FIG. 2, the embodiment shown has a gap between the top rails and the webbing which is allowed by OSHA regulations. Thus, the webbing does not have to be the exact height of the elongated bodies with which it is used.

As with the elongated bodies, any number of commonly available webbing materials will function well with this invention. For example, commonly available chicken wire or interwoven steel wire fencing could be used successfully. Choices as to the webbing to be used are dictated by factors such as safety regulations governing the desired use, cost of materials, and strength and resilience of the webbing.

Particular success has been achieved using a commercially available plastic webbing which can be purchased in any size or color desired. This plastic webbing is very lightweight and at the same time is very strong, with some examples having a breaking strength of approximately 1200 pounds per square inch. This type of webbing is sufficiently rigid to allow the elimination of toe boards which are required along the bottom of some barriers to prevent objects from being pushed underneath the barrier.

Regardless of the above configuration of elongated bodies and webbing used, the weight of the elongated bodies and webbing material is such that all the components required to install the barrier in accordance with the present invention can be easily moved into position by a single person in a relatively short period of time. Assembly and use of earlier barrier systems can require among other things, a forklift to lift the materials, hammers, wrenches, drills and electricity to run them, and a dumpster for scrap. A barrier system constructed in accordance with the present invention requires one person with a hammer. Similarly, when the construction is complete, the barrier constructed in accordance with the present invention can be removed by a single person in a short period of time. Further, a number of the locking pins and webbing material can be used interchangeably with various elongated bodies.

Another advantage of barrier systems constructed in accordance with the present invention is their virtually unlimited adaptability to the varying conditions found on the construction site. Whether a complete enclosure around an entire work space is needed or a barrier along one side of a work space is all that is needed, this barrier system can be assembled and used with equal ease. The side of the structure to which the system is attached is unimportant. By adding more elongated bodies and railing and using additional webbing, the barrier system can be used with virtually any construction site no matter how large. At the other end of the spectrum, barrier systems can be used at sites no matter how small. No matter how small the work space to be enclosed is, the barrier system can be used so long as there is sufficient room to drive nails for the elongated body bracket system. Also, no special equipment is required to create a gate in the barrier system. To create a gate, one simply cuts the webbing material along its height so that it can swing and allows for an overlap within the elongated body. Thus, when the gate needs to be opened, one simply removes a locking pin and opens the gate to pass through. When the gate does not need to be opened, the webbing is put back across the elongated body and the locking pin is put in place and the barrier constructed with the barrier system is as strong as ever. This is a particularly useful feature since it does not require the positioning of gates which need to be pre-arranged or fixed during construction.

Figure 3A:
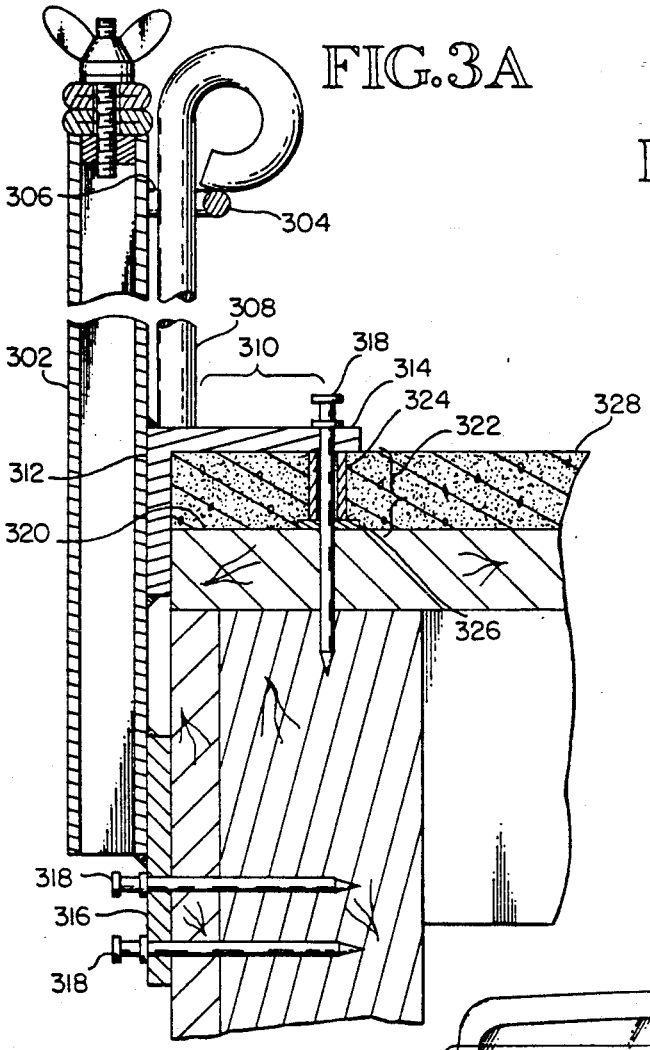
FIG. 3A is a partial cross-sectional view of a preferred embodiment constructed in accordance with the present invention.
Figure 9:
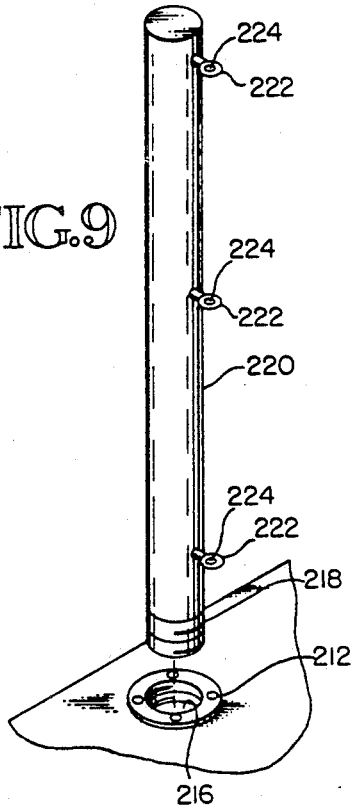
FIG. 9 is a partial isometric view of an alternative preferred embodiment constructed in accordance with the present invention.
Figure 8:
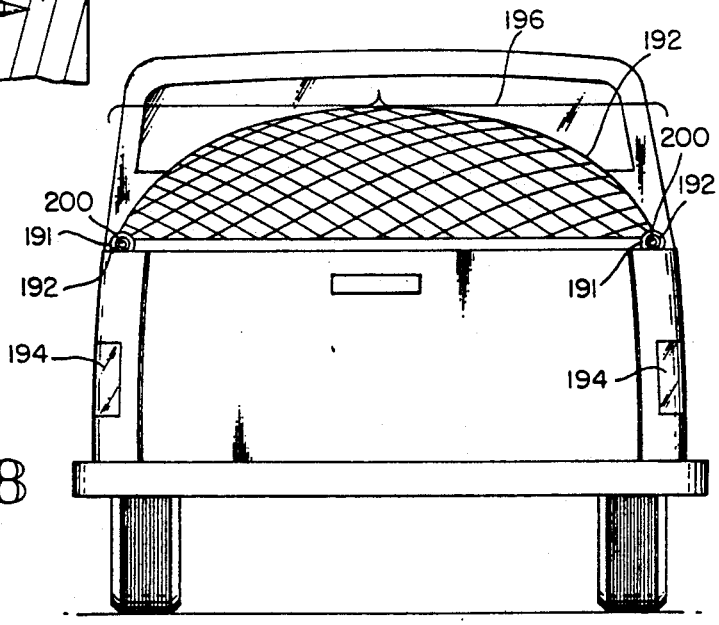
FIG. 8 is a back elevation view of an alternative preferred embodiment constructed in accordance with the present invention.

An alternative preferred embodiment of the present invention, illustrated in FIG. 3A, is particularly useful in situations where barrier systems are needed around areas in which concrete is to be poured, such decks or patios for apartment buildings. As with the above embodiment, this embodiment uses a plurality of rod-like elongated bodies 302 with each body having a plurality of loops 304 arrayed along it. The loops form a plurality of openings 306 that are substantially aligned with one another along each elongated bodies. Netting (not shown) is arrayed along the elongated bodies when they are fixed to the construction structure, and held in place at each elongated body by a locking pin 308 that is passed through the openings as the loops extend through the netting.

This embodiment has a bracket system uses a bracket system with a "L-shaped" upper bracket 310, formed from a first plate 312 and a second plate 314, and a lower bracket 316. The upper and lower brackets, and thereby the elongated bodies, are held in place by nails 318 through holes in the bracket. Each nail which passes through the upper bracket second plate is enclosed from the deck base 320 to the upper bracket second plate by a spacer 322. Each spacer has a cylindrical body 324. Spacers can be joined by a base plate 326 which allows the spacers for one bracket to be positioned at one time.

By placing the spacers before the concrete 328 is poured, the barrier system can be left in place during the concrete pouring and then removed easily since the nails are not set in the concrete.

Figure 4A:
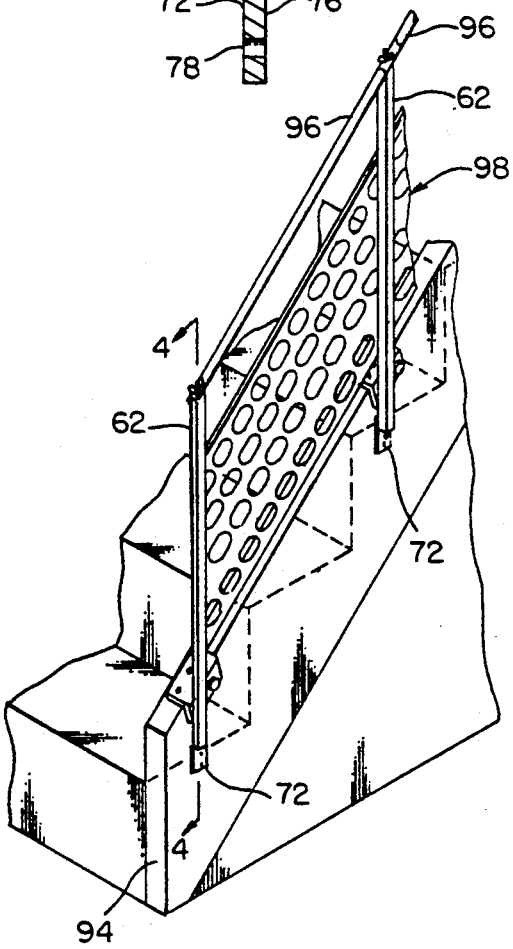
FIG. 4A is a partial isometric view of an alternative preferred embodiment constructed in accordance with the present invention.

Another alternative embodiment is shown in FIGS. 4 and 4A. As with the above embodiment this barrier system uses an elongated body 62 loops arrayed along the length of each elongated body forming substantially aligned openings with one another along the elongated body. The bracket system 68 also has an upper bracket 70 and a lower bracket 72. In this embodiment, the lower bracket is a flat plane attached to the elongated body bottom 74. The planer surface 76 of the lower bracket is oriented so that its planar surface is oriented in substantially the same direction that the elongated body loops extend. In this embodiment, however, the lower bracket extends downward from the elongated body bottom with the holes 78 being below the elongated body bottom.

The upper bracket of this embodiment has a first plate 80 and a second plate 82 joined along common edge to form an "L-shaped" bracket as in the above embodiment. The first plate is attached to the elongated body with its planar surface oriented so that it faces in the same direction that the elongated body loops extend and is substantially parallel to the lower bracket planar surface.

Unlike the above embodiment, the upper bracket is pivotally attached to the elongated body. As shown in FIG. 4, there is a pin 88 which extends from the upper bracket first plate through a hollow pin body 90, and is fixed into position by a retaining plate 92 affixed to the pin on the opposite side of the pin body. As a result, the upper bracket can pivot about so that the elongated body can be attached to a piece of lumber such as the angled beam 94 that forms part of an unfinished staircase while the elongated body still remains substantially normal to the ground. As with the above embodiments, top rails 96 and webbing 98 can be used. The attachment mechanism for attaching the webbing to the elongated bodies once the elongated bodies are in position is virtually identical to that described above with a locking pins (not shown) passing through the aligned openings on each elongated body after the webbing has been placed across the elongated body.

Figure 5:
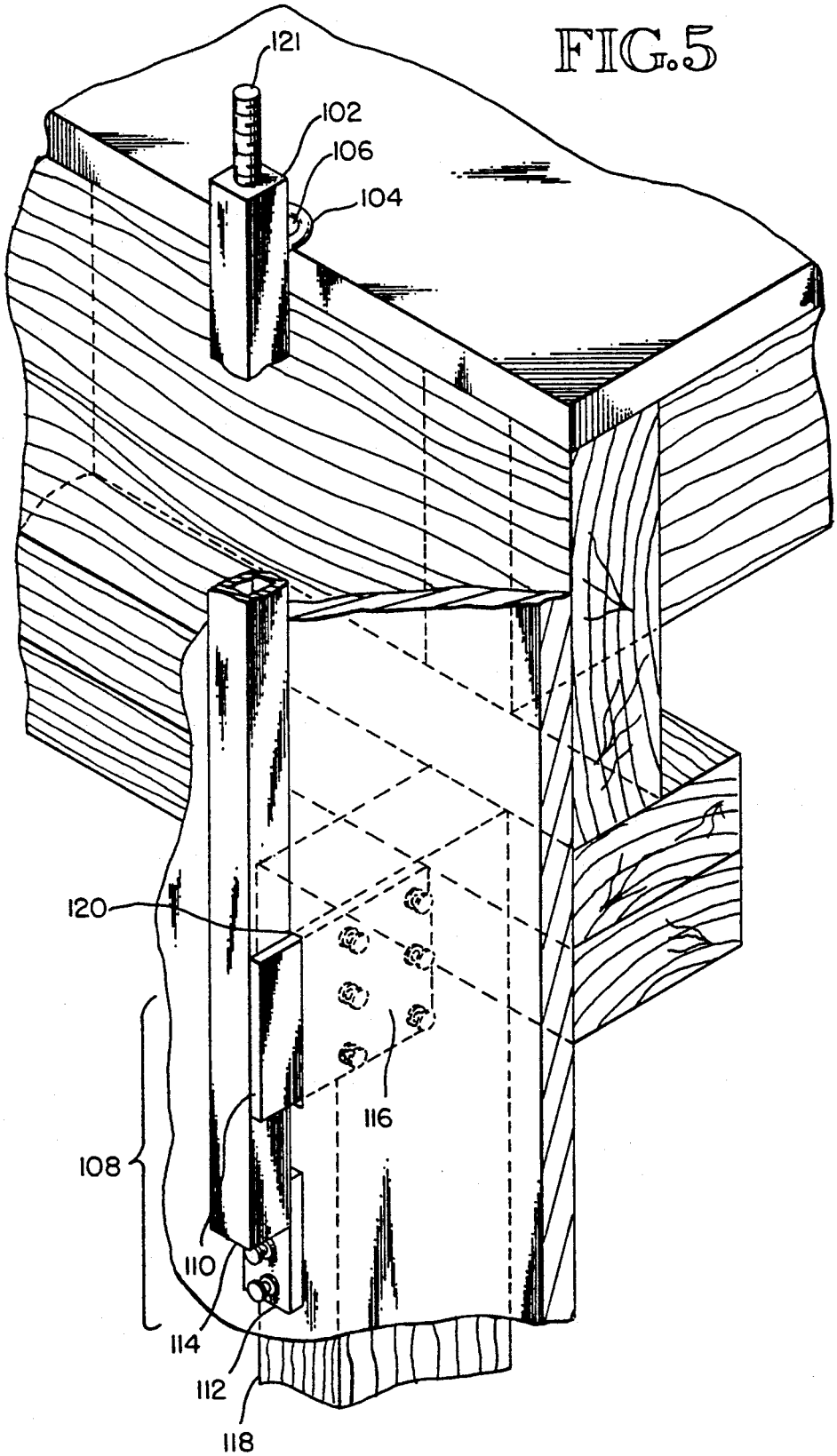
FIG. 5 is a partial isometric view of an alternative preferred embodiment constructed in accordance with the present invention.

Yet another alternative preferred embodiment of the present invention is shown in FIG. 5. As with the other embodiments of the present invention, this embodiment uses an elongated body 102 with each body having a plurality of loops 104 arrayed along it and extending out from it. Each loop has an opening 106 and the openings of the loops on each elongated body are substantially aligned with one another along the elongated body. The bracket system 108 in this embodiment has an upper bracket 110 and a lower bracket 112. As described with certain of the above embodiments, the lower brackets in this embodiment is a flat plate that is attached to and extends downward from the elongated body bottom 114.

The upper bracket in this embodiment is a single plate which is attached to the elongated body along its length. The upper bracket extends outward from the elongated body in the same direction that the elongated body loops extend. In this embodiment, however, the planar surface 116 of the upper bracket is substantially parallel to the elongated body. This embodiment is particularly useful in attaching an elongated body to an upright piece of lumber such as a wall stud 118 of a lower floor so that a safety barrier may be constructed for work on an upper floor or ceiling.

This embodiment can be used with wall sheeting 119 attached to the wall studs. A narrow slot 120 is cut through the sheeting proximate a wall stud, the upper bracket is inserted into the slot next to the wall stud, and the brackets are nailed in place, as shown in FIG. 5. When the elongated body is removed, the slot is easily covered.

As with the above embodiments, locking pins are provided to complete an attachment mechanism for webbing material which can also be used. Similarly, there is a threaded stud 121 extending from the elongated body top which allows top rails to be used.

Figure 6:
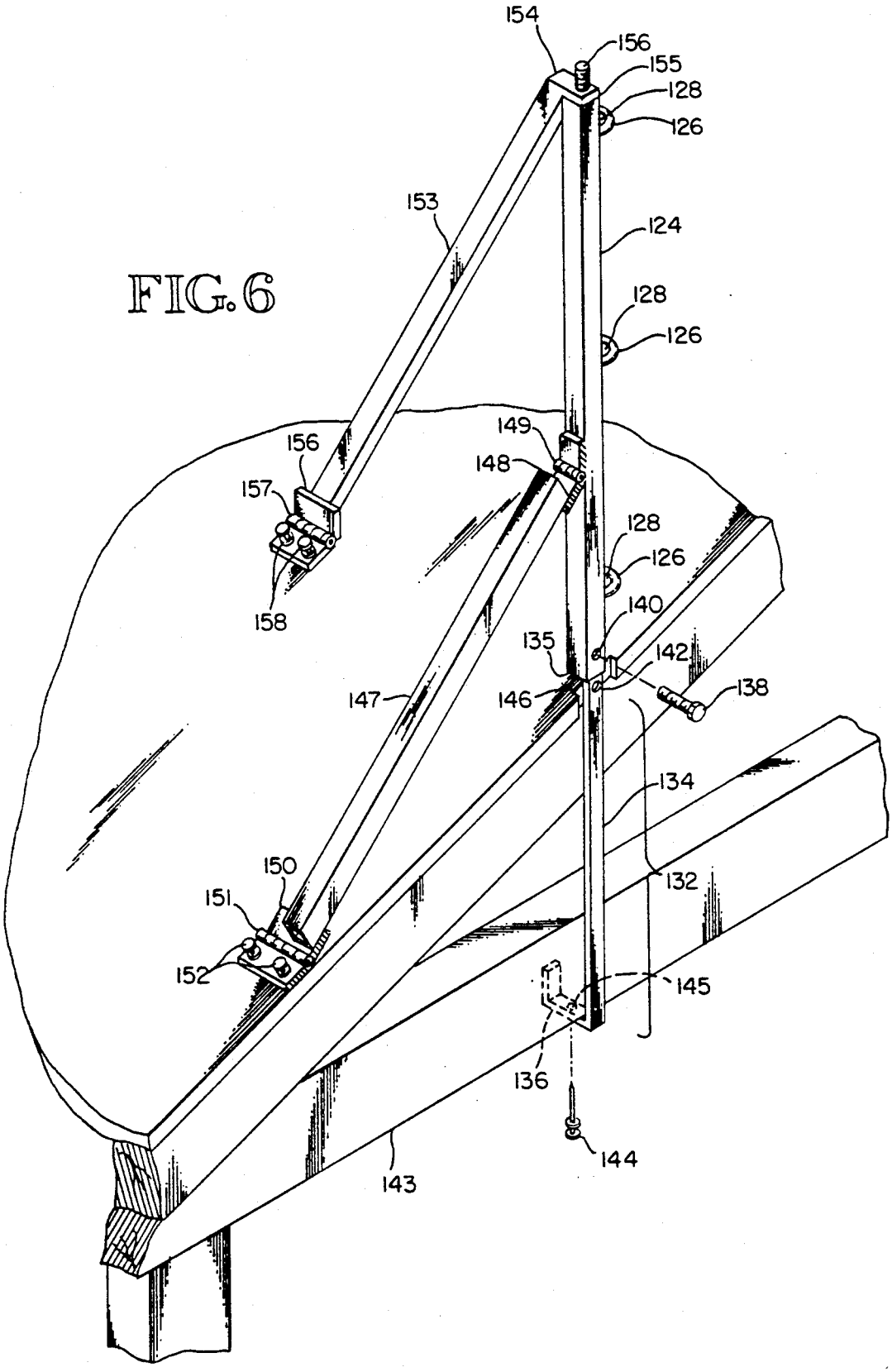
FIG. 6 is a partial isometric view of an alternative preferred embodiment constructed in accordance with the present invention.

A further alternative preferred embodiment of the present invention is illustrated in FIG. 6. This embodiment uses an elongated body 124 with each body having a plurality of loops 126 extended along its length. Each loop has an opening 128 and the openings on a particular elongated body are substantially aligned with one another along the elongated body. A bracket system for this embodiment has a curved bracket 132 that has a straight portion 134 which slidably fits into the bottom 135 of the elongated body and a cup portion 136 which extends out from the straight portion end not fit into the elongated body bottom and back up towards the elongated body. The curved bracket can be formed from any number of materials including steel strips, which has been used with success.

The curved bracket is a "J-shape" when viewed from the side. The distance of the cup portion of the curved bracket extends away from the elongated bracket can be adjusted by using a removable pin 138 which passes through a hole 140 in the elongated body and one of a plurality of holes 142 arrayed along the straight portion of the curved bracket.

When the curved bracket is placed with the cup portion around a truss bottom 143, a nail 144 is driven through a hole 145 in the cup portion to hold the cup portion in place. The elongated body is then slid over the curved bracket until it is at the appropriate height the removable pin is put in place. Since this embodiment is usually used on roofs under construction, a small slot 146 like the one shown in FIG. 6 can be cut in the plywood used to form the roof. This slot allows the curved bracket to pass through the roof.

Instead of using a second bracket as is present in most of the other embodiments discussed above, the elongated body of this embodiment uses a primary brace 147 which is attached at its upper end 148 by a pivotal hinge 149 to the elongated body. At the brace lower end 150 there is a hinged bracket 151 that is pivotally attached to the brace lower end, the lower end hinged bracket held in place by nails 152. By having both ends of the brace hinged, the elongated body can be positioned in a upright position substantially normal to the ground and supported by the brace regardless of the angle of the roof. The primary brace upper end can be attached anywhere along the elongated body.

Good results have been obtained by attaching the primary brace to the elongated body at a height equal to approximately one-third to one-half of the elongated body length. The upper end of the primary brace and its pivotal hinge can be attached to the elongated body in a variety of ways. It has been found that welding or other means of permanently affixing the pivotal hinge to the elongated body has yielded good results, or it could be bolted to the elongated body if it was desirable to be able to remove the primary brace from the elongated body when not in use. Once the elongated bodies are in position, webbing material (not shown) can be positioned and attached using attachment mechanisms substantially similar to those discussed in the above embodiments.

If it is desired to provide additional structural strength to the elongated body in this embodiment, a secondary brace 153 can be attached. This brace is oriented so that it is approximately 90° from the primary brace. The upper end 154 of the secondary brace is attached to the elongated body proximate its top with its sides. This can be done by sliding the secondary brace upper end over a threaded stud 156 which extends upward from the elongated body top. The lower end 156 of the secondary brace has a pivotal hinge 157 which can be attached to the roof by nails 158. This pivotal hinge is oriented in the same direction as the pivotal hinges of the primary brace, that is, so that the lower end of the secondary brace can accommodate roofs and other flat surfaces of varying pitches. The secondary brace projects out from the elongated body at a 90 degree angle to both the direction that the primary brace extends from the elongated body and the direction the loops extend from the elongated body since the primary brace and the loops extend at direction 180 degrees from one another.

With the secondary brace in position, an elongated body of this embodiment is secured in three directions. The curved bracket secures the elongated body from the bottom, the primary brace supports the elongated body against forces pushing outward from the work space to be enclosed, and the secondary brace provides strength against side-to-side motion.

When construction of the roof is complete, nails 166 holding the brace lower end in position can be removed, the pin pulled from the elongated body and the curved bracket merely pushed back through the slot in the roof which can then be covered by roofing material. This embodiment is particularly useful in any circumstance where a flat surface is being worked upon, particularly when it is difficult to reach an edge and/or the surface itself is at an angle.

While each of the above embodiments disclose unique features and applications they have certain features in common. They all use lightweight, relatively simple, elongated bodies which are positioned in a relatively upright position due to a variety of bracket systems. While the bracket systems disclosed are certainly illustrative, they are by no means exhaustive and small variations in size, shape or orientation of the individual brackets from those disclosed are certainly envisioned with this invention.

Similarly, the attachment mechanism for attaching the webbing to the upright elongated bodies is substantially similar for the different embodiments. By using the substantially aligned loops which extend through the webbing and then fixing the webbing into position by the use of locking pins which extend through the aligned openings an attachment mechanism is provided which provides strength, ease of assembly and disassembly and absolute simplicity of operation.

This attachment mechanism has applications in areas not directly related to construction sites. For example, fence posts 170 with a plurality of loops 172 with openings 174 that are substantially aligned from one another along each fence post would allow the construction of strong, lightweight timber fencing on the ground. Such an application can find uses to construct temporary livestock pens, kennels, or can be used for crowd control at outdoor concerts or festivals. A variation of this embodiment are shown in FIG. 7A which uses rings 176 which will slide over a metal fence post 178 and are held in position by a tightener, in this case, screws 180 that can be tightened by hand. While FIG. 7A shows two screw tighteners, different numbers could be used depending on the application. The loops 182 are attached to the rings and provide the openings 184. Another variation is shown in FIG. 7B which uses loops 186 that have threaded portions 188 and are screw into wooden fenceposts 190.

Another possible application could be found in providing a system for preventing loads carried on open-bed trucks, trailers and similar vehicles can be constructed by providing a plurality of loops 191 having substantially aligned openings 192 on either side 194 of an open truck bed 196, such a temporary cover could be provided. By laying webbing 198 across the loops on one side of the truck and passing a rod 200 through the opening, and then passing the webbing over the objects in the truck bed and locking the webbing in position with a rod on the opposite side of the truck, a cover is created that will retain objects in the truck bed until the rods are removed. Mechanisms will be provided to hold the rods in place.

Similarly, preferred embodiments using bracketing systems adapted to nuts and bolts allow the barrier systems as used with wood based construction described above to be used in steel based construction such as highrise buildings and bridges. This embodiment uses a base plate 210 that is bolted or affixed by other means to a steel surface 212. The base plate has a threaded opening 216 which receives the threaded end 218 of a post 220. The post has a plurality of loops 222 arrayed along it. The loops form a plurality of openings 224 that are substantially aligned along the post. The attachment mechanism is substantially the same as described for the other embodiments.

Figure 10:
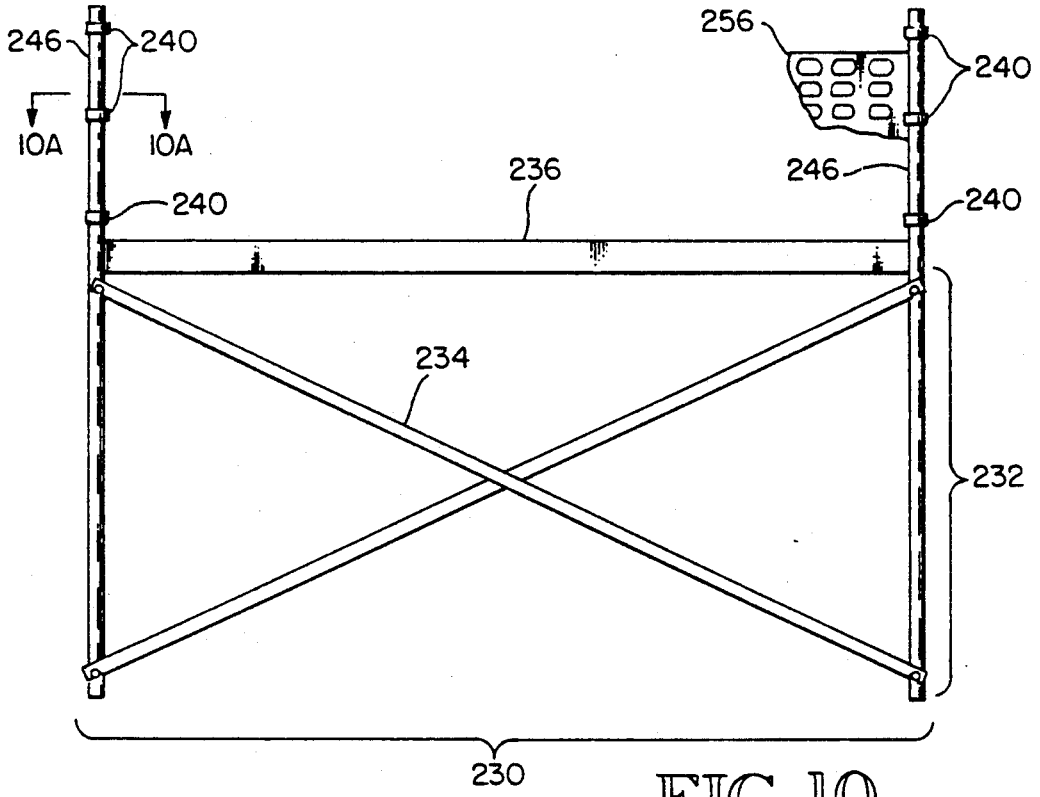
FIG. 10 is a side elevation view of an alternative preferred embodiment constructed in accordance with the present invention.
Figure 10A:
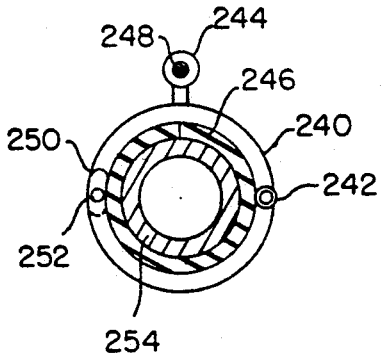
FIG. 10A is a partial cross-sectional view of a preferred embodiment constructed in accordance with the present invention taken along lines 10A—10A in FIG. 10.

Other embodiments of the present invention allow the barrier system to be used with existing structures or restraint systems. One example of this embodiment is given in FIGS. 10 and 10A. The structure 230 shown in FIG. 10 is known in the construction industry as "tinker toy scaffolding" and consists of end pieces 232 that are supported by cross braces 234. In use, the scaffolding is assembled against the side of a building and workers stand on wooden planks 236 which are placed between the end pieces. At present, the railing for such scaffolding is not legal because it fails to meet safety regulations. This embodiment uses a plurality of rings 240, each one of which has a hinge 242. Also attached to each ring is a loop 244. To create the attachment mechanism for this scaffolding, a plurality of rings is arrayed around each upright 246 and oriented so that the openings 248 of the loops on a particular upright are substantially aligned with one another along the uprights. When the openings are aligned for a particular upright, the ends 250 of the ring are pushed together and a retaining pin is placed through the pin ends to hold them together.

To prevent the rings from moving up and down the upright, a holder 254 is incorporated. In this particular embodiment, a holder could be an elastomeric lining on the ring which could be squeezed tightly against the upright. Other ways of retaining the rings in place are envisioned such screw tighteners discussed with other embodiments. Once the rings are in place and the aligned loops are arranged, webbing material 256 can be put in place and retained by locking pins (not shown). This particular embodiment is very valuable since it will allow existing structures and systems that might otherwise be obsolete to be used by allowing them to meet existing safety regulations.

INDUSTRIAL APPLICABILITY

This invention is applicable to the construction of strong but temporary barriers. This invention would be useful in any situation where one needed to quickly and efficiently erect a relatively strong fixed barrier which could be as easily removed with a minimum of time, labor and expense. This invention is particularly applicable for safety restraints on construction sites and for the construction of other temporary barriers such as livestock pens.

In compliance with the statute, the invention has been described in language more or less specific as to structural features, it is understood, however, that the invention is not limited to the features shown, since the means and construction herein disclosed describes preferred forms of putting the invention to effect. The invention, therefore, is claimed in any of its forms or applications within the legitimate and valid scope of the intended claims.

I claim:

1. A barrier system, said barrier system comprising:

a plurality of elongated bodies, each said body having a length, sides, a top, and a bottom;

a bracket system, said bracket system being used to affix each said elongated body to a structure where a barrier is desired, so that each said elongated body length is substantially normal to the ground; and an attachment mechanism, said attachment mechanism being used to fixedly, but removably, attach webbing to said elongated bodies to create a barrier, said attachment mechanism also having a plurality of locking pins, said attachment mechanism attaching said webbing to each said elongated body with one said locking pin for each said elongated body.

2. A barrier system as claimed in claim 1, said attachment mechanism further comprising:

a plurality of loops fixedly attached to and arrayed along the length of each said elongated body, each said plurality of loops extending in substantially a single direction and forming a plurality of openings, said opening being substantially aligned with one another along said elongated body to which said plurality of loops are attached and each said locking pin slidably fitting through said openings on one said elongated body simultaneously.

3. A barrier system as claimed in claim 2, said bracket system further comprising:

a plurality of lower brackets, one said lower bracket attached to the bottom of each said elongated body, each said lower bracket further having a planar surface, said planar surface facing in the same direction as said loops attached to said elongated body extend; and a plurality of upper brackets, one said upper bracket attached to each said elongated body, each said upper bracket having a first plate with a first plate planar surface and a second plate with a second plate planar surface with said first plate and said second plate being attached together along a common edge at substantially 90° angle between said first plate and said second plate, with said first plate being fixedly attached to said elongated body with said first plate planar surface being substantially parallel to said elongated body and said second plate planar surface being substantially normal to said elongated body and said second planar surface of said second plate extending away from said elongated body in substantially the same direction as said loops on said body.

4. A barrier system as claimed in claim 2, said bracket system further comprising:

a plurality of lower brackets, one said lower bracket attached to the bottom of each said elongated body, each said lower bracket further having a planar surface, said planar surface facing in the same direction as said loops on said elongated body; and a plurality of upper brackets, one said upper bracket being attached to each said elongated body, each said upper bracket being a substantially flat plate with a planar surface and said upper bracket being attached to and along said elongated body so that said upper bracket planar surface is substantially parallel to said elongated body and said upper bracket plate extends away from said elongated body in substantially the same direction as said loops on said elongated body.

5. A barrier system as claimed in claim 3, said barrier system further comprising a plurality of top rails, said top rails being attached to said elongated body tops after said elongated bodies have been positioned and attached to a desired structure by said bracket system with one said top rail connecting said tops of two said elongated bodies where said elongated bodies are adjacent to one another.

6. A barrier system as claimed in claim 4, said barrier system further comprising a plurality of top rails, said top rails being attached to said elongated body tops after said elongated bodies have been positioned and attached to a desired structure by said bracket system with one said top rail connecting said tops of two said elongated bodies where said elongated bodies are adjacent to one another.

7. A barrier system as claimed in claim 2, said bracket system further comprising:

a plurality of curved brackets, one said curved bracket being fit to each said elongated body, and each said curved bracket having a straight portion with two ends, one said straight portion end slidably fitting into and fixedly attached to said bottom of said elongated body and said other end of said straight portion attached to a cup portion which extends out, said cup portion first extending out from said straight portion and then up in the same direction as said straight portion; and a primary brace, said primary brace having a plurality of primary braces, one said primary brace being attached to each said elongated body, each said primary brace having a body with an upper end and a lower end with said primary brace extending out from said elongated body in a direction substantially 180° from the direction in which said loops on said elongated body, and said primary brace upper end fixedly attached to said elongated body by a pivotal hinge and said primary brace lower end being attached to a lower hinged bracket.

8. A barrier system as claimed in claim 7, wherein said bracket system further comprises a plurality of secondary braces with one said secondary brace for each said elongated body, and each secondary brace having an upper end that is attachable to said elongated body top and a lower end fixedly attached to a pivotal hinge so that when said secondary brace is attached to said elongated body said secondary brace extends about from said elongated body in a direction that is substantially 90° to the direction of said loops on said elongated body and to the direction that said primary brace which is attached to said elongated body.

9. A barrier system as claimed in claim 2, said bracket system further comprising:

a plurality of base plates, one said base plate being provided for each said elongated body, each said base plate being fixedly attachable to a structure where a barrier is desired and each base plate further having a threaded aperture; and each elongated body having its bottom threaded so that it is threadably fit into a corresponding base plate.

10. A barrier system as claimed in claim 2, said bracket system further comprising:

a plurality of lower brackets, one said lower bracket attached to the bottom of each said elongated body, each said lower bracket further having a planar surface, said planar surface facing in the same direction as said loops attached to said elongated body extend; and a plurality of upper brackets, one said upper bracket attached to each said elongated body, each said upper bracket having a first plate with a first plate planar surface and a second plate with a second plate planar surface with said first plate and said second plate being attached together along a common edge at substantially 90° angle between said first plate and said second plate, with said first plate being pivotally attached to said elongated body with said first plate planar surface being substantially parallel to said elongated body and said second plate planar surface being substantially normal to said elongated body and said second planar surface of said second plate extending away from said elongated body in substantially the same direction as said loops on said body.

* * * * *